US010792929B2

(12) United States Patent
Maeshima

(10) Patent No.: US 10,792,929 B2
(45) Date of Patent: Oct. 6, 2020

(54) SUPPLY LIQUID TANK UNIT AND INKJET RECORDING APPARATUS THEREWITH

(71) Applicant: KYOCERA Document Solutions Inc., Osaka (JP)

(72) Inventor: Masanobu Maeshima, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 16/026,956

(22) Filed: Jul. 3, 2018

(65) Prior Publication Data

US 2019/0030908 A1 Jan. 31, 2019

(30) Foreign Application Priority Data

Jul. 28, 2017 (JP) ..... 2017-146370

(51) Int. Cl.
*B41J 2/175* (2006.01)

(52) U.S. Cl.
CPC ..... *B41J 2/17566* (2013.01); *B41J 2/175* (2013.01); *B41J 2002/17576* (2013.01)

(58) Field of Classification Search
CPC ..... B41J 2/17566; B41J 2/175; B41J 2002/17576; B41J 2/01; B41J 2/17506; B41J 2/17556; B41J 2/19; B41J 2002/17569; B41J 2002/17573; B41J 2002/17579; B41J 2002/17583; B41J 2002/17586; B41J 2002/17589
See application file for complete search history.

(56) References Cited

U.S. PATENT DOCUMENTS

2005/0248607 A1 11/2005 Matsuba et al. ..... 347/24
2013/0187985 A1* 7/2013 Katoh ..... B41J 2/175 347/47

FOREIGN PATENT DOCUMENTS

CN 1693087 A 11/2005
JP 2016-175182 A 10/2016

* cited by examiner

*Primary Examiner* — Kristal Feggins
(74) *Attorney, Agent, or Firm* — Stein IP, LLC

(57) ABSTRACT

A supply liquid tank unit of the present disclosure includes a supply liquid tank and a detection sensor. The detection sensor detects a liquid surface of ink in the supply liquid tank. The supply liquid tank is provided with an inner space having a storage chamber which stores the ink and an atmosphere release port for making an inner pressure in the inner space equal to an atmospheric pressure. The detection sensor has a float which moves vertically in accordance with an amount of the ink in the storage chamber and a sensor main body which detects a liquid surface of the ink when the float moves vertically. An inner side surface of the storage chamber is disposed along and near an outer circumferential surface of the float.

8 Claims, 7 Drawing Sheets

SUPPLY LIQUID TANK UNIT AND INKJET RECORDING APPARATUS THEREWITH

INCORPORATION BY REFERENCE

This application is based upon and claims the benefit of priority from the corresponding Japanese Patent Application No. 2017-146370 filed on Jul. 28, 2017, the entire contents of which are incorporated herein by reference.

BACKGROUND

The present disclosure relates to a supply liquid tank unit including a supply liquid tank which stores ink to be supplied to a recording head which ejects ink onto a recording medium such as a sheet and a detection sensor which detects a liquid surface of ink in the supply liquid tank, and to an inkjet recording apparatus provided therewith.

An inkjet recording apparatus that ejects ink to form an image is capable of forming a high-definition image and thus is widely used as a recording apparatus such as a facsimile, a copy machine, or a printer.

In such an inkjet recording apparatus, in order to supply ink to a recording head, there are provided a flexible ink pack filled with ink and a sub ink tank which is disposed between the ink pack and the recording head. The sub ink tank is provided with a detection sensor which detects an amount of ink in the sub ink tank, and when the amount of ink therein decreases to below a predetermined amount, ink is replenished from the ink pack into the sub ink tank.

The sub ink tank is so disposed that a liquid surface of ink in the sub ink tank is below a lower end of an ink ejection port of the recording head. Furthermore, the sub ink tank is provided with an atmosphere release port for making the pressure in the internal pressure in its inner space where ink is stored equal to an atmospheric pressure. With this configuration, a negative pressure is applied to ink in the recording head, and an ink meniscus is formed at a predetermined position (at the lower end of the ink ejection port) in the recording head.

SUMMARY

According to a first aspect of the present disclosure, a supply liquid tank unit includes a supply liquid tank and a detection sensor. The supply liquid tank stores ink to be supplied to a recording head which ejects the ink onto a recording medium. The detection sensor detects a liquid surface of the ink in the supply liquid tank. The supply liquid tank is provided with an inner space having a storage chamber which stores the ink and an atmosphere release port for making an internal pressure in the inner space equal to an atmospheric pressure. The detection sensor has a float which moves vertically in accordance with an amount of the ink in the storage chamber and a sensor main body which detects a liquid surface of the ink when the float moves in a vertical direction. An inner side surface of the storage chamber is disposed along and near an outer circumferential surface of the float.

Still other objects of the present disclosure and specific advantages obtained by the present disclosure will become further apparent from the following description of embodiments.

DETAILED DESCRIPTION

Hereinafter, with reference to FIG. 1 to FIG. 10, an embodiment of the present disclosure will be described with reference to the accompanying drawings.

Figure 1:
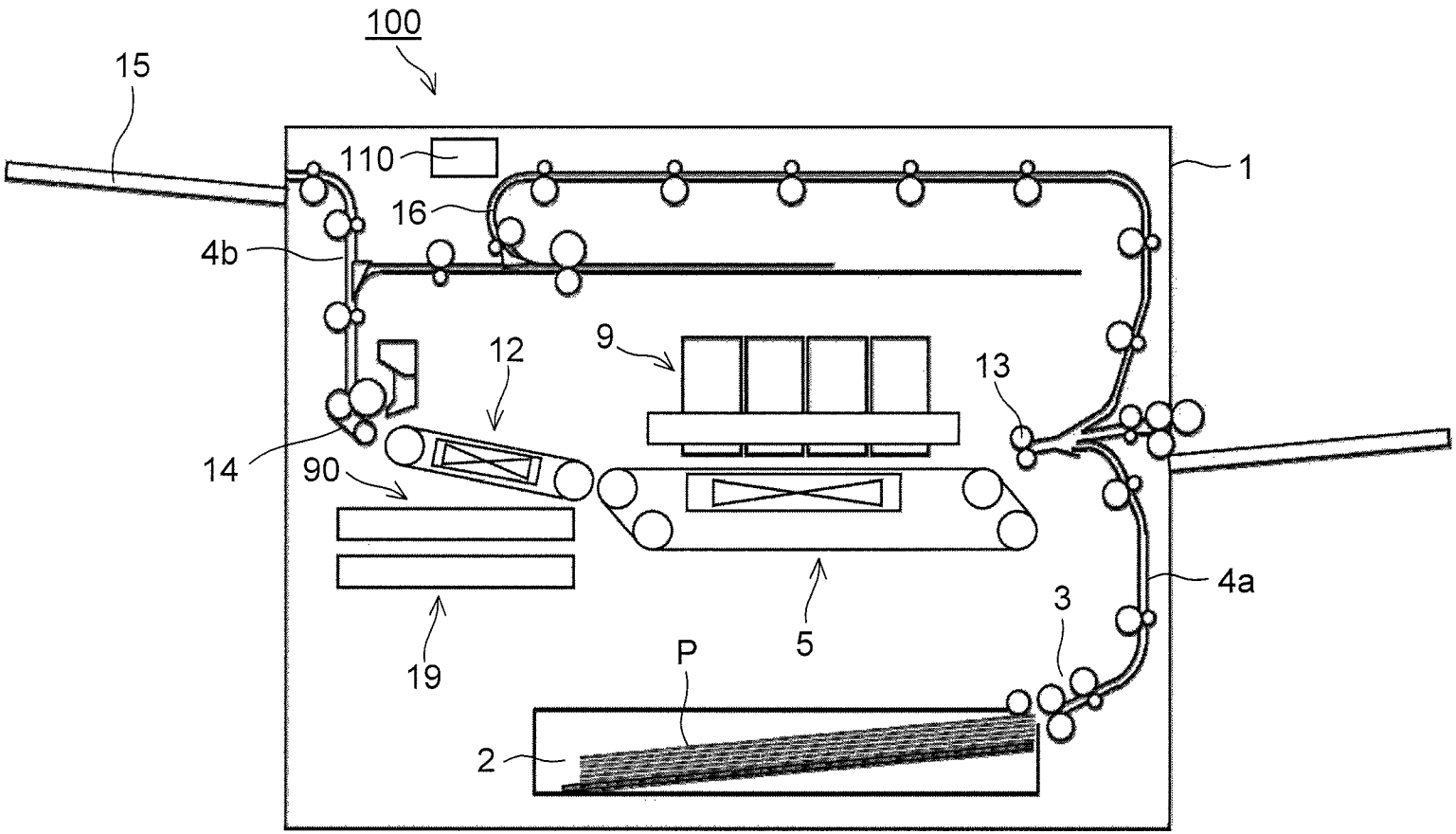
FIG. 1 is a diagram illustrating a structure of an inkjet recording apparatus including a supply liquid tank unit according to an embodiment of the present disclosure.

With reference to FIG. 1 to FIG. 10, a description will be given of an inkjet recording apparatus 100 including a supply liquid tank unit 60 according to an embodiment of the present disclosure. As shown in FIG. 1, in the inkjet recording apparatus 100, in a lower part inside an apparatus main body 1, a sheet cassette 2 is disposed as a sheet storage portion. In the sheet cassette 2, there are stored sheets P as an example of a recording medium. On a downstream side of the sheet cassette 2 in a sheet conveyance direction, in other words, to the upper right of the sheet cassette 2 in FIG. 1, there is disposed a sheet feeding device 3. By the sheet feeding device 3, the sheets P are fed, one sheet after another separately, in a right-upward direction from the sheet cassette 2 in FIG. 1.

Furthermore, the inkjet recording apparatus 100 includes a first sheet conveyance passage 4*a* disposed therein. The first sheet conveyance passage 4*a* is located to the upper right of the sheet cassette 2 along a direction in which a sheet is conveyed from the sheet cassette 2. A sheet P fed from the sheet cassette 2 is conveyed through the first sheet conveyance passage 4*a* upward along a side surface of the apparatus main body 1.

At a downstream end of the first sheet conveyance passage 4*a* with respect to the sheet conveyance direction, a registration roller pair 13 is disposed. Furthermore, on a downstream side of the registration roller pair 13 in the sheet conveyance direction, a first conveyance unit 5 and a recording portion 9 are disposed. The sheet P fed from the sheet cassette 2 passes through the first sheet conveyance passage 4*a* and reaches the registration roller pair 13. The registration roller pair 13 corrects oblique feeding of the sheet P, and feeds it toward the first conveyance unit 5, with timing coordinated with an ink ejecting operation performed by the recording portion 9.

On a downstream side (a left side in FIG. 1) of the first conveyance unit 5 with respect to the sheet conveyance direction, there is disposed a second conveyance unit 12. The sheet P on which an ink image has been recorded at the recording portion 9 is sent to the second conveyance unit 12, and while the sheet P is passing through the second conveyance unit 12, ink that has been ejected onto a surface of the sheet P is dried.

At a position on a downstream side of the second conveyance unit 12 with respect to the sheet conveyance direction, close to a left side surface of the apparatus main body 1, there is disposed a decurler portion 14. The sheet P, on which the ink has been dried at the second conveyance unit 12, is sent to the decurler portion 14, where a curl in the sheet P is corrected.

On a downstream side of the decurler portion 14 with respect to the sheet conveyance direction (above the decurler portion 14 in FIG. 1), there is disposed a second sheet conveyance passage 4*b*. The sheet P having passed through the decurler portion 14 is, unless double-side recording is to be performed, fed through the second sheet conveyance passage 4*b* to be discharged into a sheet discharge tray 15 provided outside a left side surface of the inkjet recording apparatus 100.

In an upper portion of the apparatus main body 1, above the recording portion 9 and the second conveyance unit 12, there is disposed a reverse conveyance passage 16 for performing a double-side recording. When a double-side recording is to be performed, the sheet P having undergone a recording on a first side thereof and having passed through the second conveyance unit 12 and the decurler portion 14 is sent through the second sheet conveyance passage 4*b* into the reverse conveyance passage 16. The sheet P having been sent into the reverse conveyance passage 16 then has its conveyance direction switched for a recording to be performed on a second side thereof, and is sent rightward through the upper portion of the apparatus main body 1, then further through the first sheet conveyance passage 4*a* and the registration roller pair 13, and then back to the first conveyance unit 5, with the second side thereof facing up.

Furthermore, below the second conveyance unit 12, there are disposed a wipe unit 19 and a cap unit 90. When later-described purge is performed, the wipe unit 19 horizontally moves to below the recording portion 9, where the wipe unit 19 wipes off ink extruded from an ink ejection port of the recording head, and collects the wiped-off ink. When capping an ink ejection surface of the recording head, the cap unit 90 horizontally moves to below the recording portion 9, where the cap unit 90 further moves upward to be attached to a lower surface of the recording head.

Figure 2:
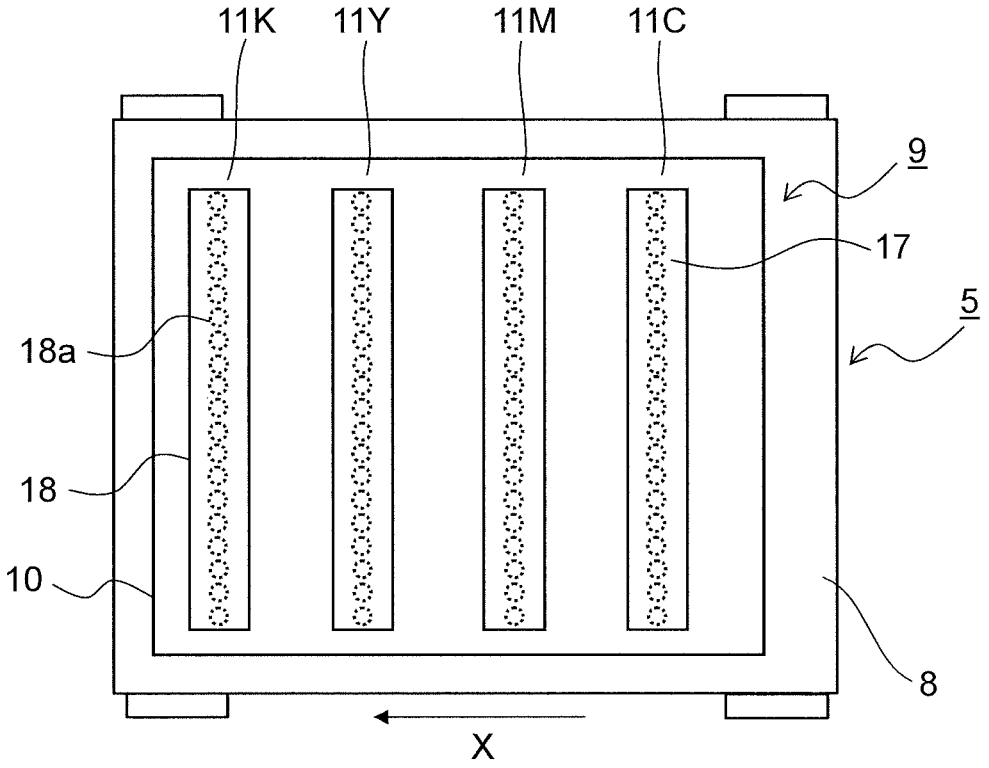
FIG. 2 is a diagram illustrating, as seen from above, a first conveyance unit and a recording portion of the inkjet recording apparatus illustrated in FIG. 1.

As illustrated in FIG. 2, the recording portion 9 includes a head housing 10 and line heads 110, 11M, 11Y, and 11K held in the head housing 10. These line heads 110 to 11K are supported at such a height that a predetermined gap (for example, of 1 mm) is formed with respect to a conveyance surface of a first conveyance belt 8 of the first conveyance unit 5, and the line heads 110 to 11K are each constituted of one or more recording heads 17 (here, one recording head 17) extending along a sheet width direction (an up-down direction in FIG. 2), which is perpendicular to the sheet conveyance direction (an arrow X direction).

Figure 3:
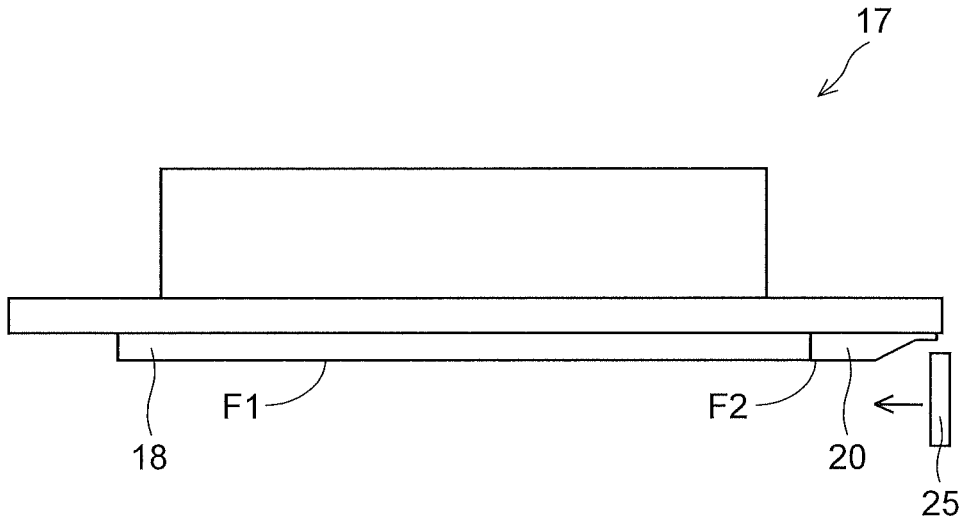
FIG. 3 is a diagram illustrating a recording head constituting a line head of the recording portion.
Figure 4:
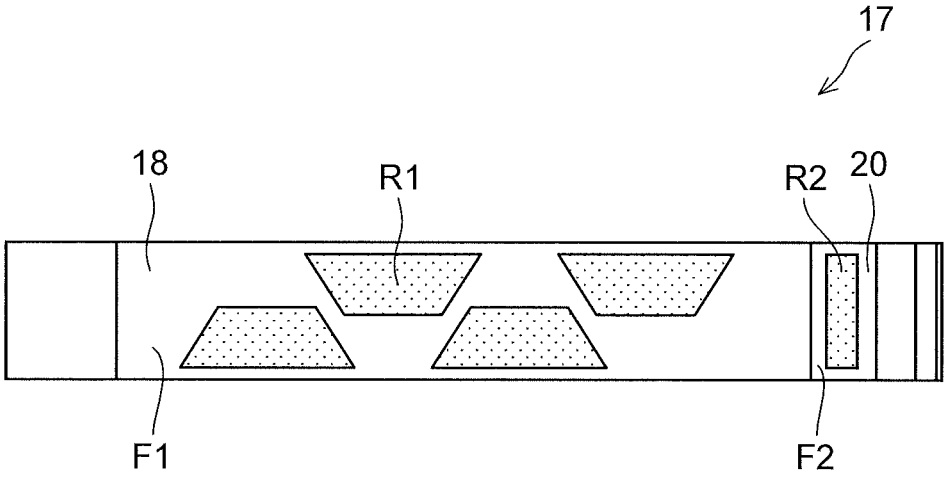
FIG. 4 is a diagram illustrating the recording head as seen from an ink-ejection-surface side.

As illustrated in FIG. 3 and FIG. 4, on an ink ejection surface F1 of a head portion 18 of the recording head 17, there is provided an ink ejection region R1 where a large number of ink ejection ports 18*a* (see FIG. 2) are arranged.

Recording heads 17, each constituting one of the line heads 11C to 11K, are each supplied with ink of one of four colors (cyan, magenta, yellow, and black) that corresponds to a color of the each of the line heads 11C to 11K.

Based on a control signal from the control portion 110 (see FIG. 1), each of the recording heads 17, in accordance with image data received from an external computer, ejects ink through the ink ejection ports 18*a* toward the sheet P, which is conveyed while being sucked and held on the conveyance surface of the first conveyance belt 8. Thereby, a color image, where inks of the four colors of cyan, magenta, yellow, and black are superimposed, is formed on the sheet P held on the first conveyance belt 8.

Furthermore, the recording heads 17 are each provided with a cleaning liquid supply member 20 which supplies a cleaning liquid. The cleaning liquid supply member 20 is disposed adjacent to an upstream side (a right side in FIG. 3) with respect to the head portion 18 in a wiping direction of a wiper 25. The cleaning liquid supply member 20 has a cleaning liquid supply surface F2 which includes a cleaning liquid supply region R2 where there are arranged a large number of cleaning liquid supply ports which supply a cleaning liquid.

Figure 5:
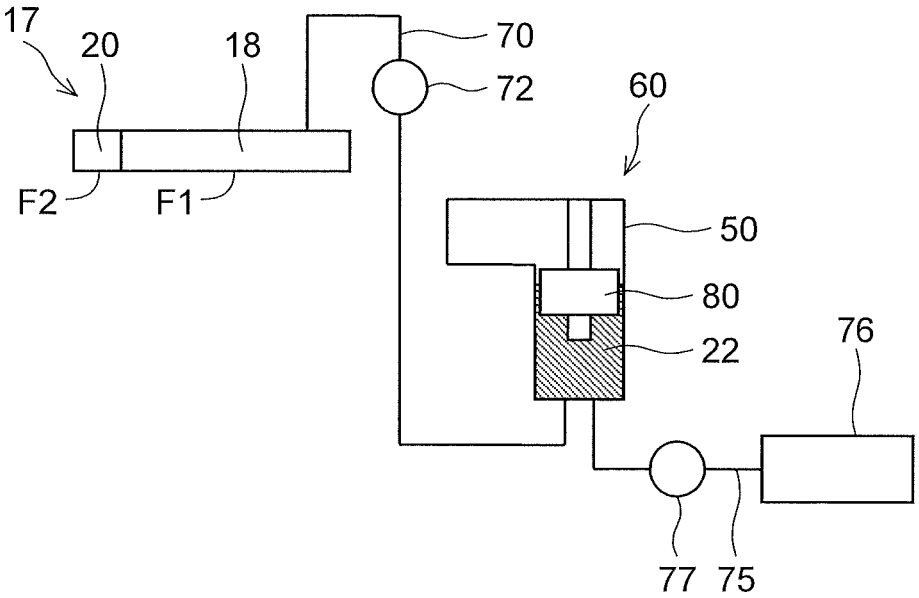
FIG. 5 is a diagram illustrating a configuration of and around the recording head, a sub ink tank, and an ink pack.

As illustrated in FIG. 5, the recording heads 17 each have connected thereto a downstream end of a corresponding one of ink supply tubes 70 through which inks 22 of the four colors respectively flow. Upstream ends of the ink supply tubes 70 are each connected to a corresponding one of sub ink tanks (supply liquid tanks) 50 which respectively store the inks 22 of the four colors to be supplied to the recording heads 17. The ink supply tubes 70 are provided with purge pumps 72 for pumping up the inks 22 from the sub ink tanks 50 to send them to the recording heads 17. In the figure, the inks 22 are hatched for easier understanding. The ink supply tubes 70, the sub ink tanks 50, the purge pumps 72, and besides, later-described ink replenishment tubes 75, ink packs 76, and replenishment pumps 77, are all provided one with respect to each of the recording heads 17, but, for simplicity of the figure, just one set thereof is illustrated in the figure.

Furthermore, the sub ink tanks 50 each have connected thereto a downstream end of a corresponding one of the ink replenishment tubes 75 through which inks 22 of the four colors respectively flow. Upstream ends of the ink replenishment tubes 75 are each connected to a corresponding one of the ink packs 76 which store the inks 22 to be replenished to the sub ink tanks 50. The ink replenishment tubes 75 are provided with replenishment pumps 77 for pumping up the inks 22 from the ink packs 76 to send them to the sub ink tanks 50. Pumps usable as the purge pump 72 and the replenishment pump 77 include, for example, a tube pump, a syringe pump, and a diaphragm pump.

The ink pack 76 is a container made of an aluminum sheet, and an inside thereof is filled with ink 22, which is deaerated ink. When the ink 22 is supplied from the ink pack 76 to the recording head 17, as the ink 22 is gradually discharged from inside the ink pack 76, the external shape of the ink pack 76 is gradually smashed from a swelled state into a flat state.

The sub ink tank 50 is provided with a detection sensor 80 for detecting a liquid surface (an upper surface) of the ink 22. When the detection sensor 80 detects absence of liquid (or a fall of liquid surface), a predetermined amount of ink 22 is replenished, by means of the replenishment pump 77, from the ink pack 76 to the sub ink tank 50. Here, the sub ink tank 50 and the detection sensor 80 which detects the liquid surface of the ink 22 in the sub ink tank 50 constitute the supply liquid tank unit 60. A detailed configuration of and around the sub ink tank 50 will be described later.

The cleaning liquid supply member 20 is so configured that a cleaning liquid is supplied by a liquid supply mechanism similar to that for the recording head 17. Specifically, to the cleaning liquid supply member 20, the cleaning liquid is supplied by using a pump from a main cleaning liquid tank to a sub cleaning liquid tank (of which neither is illustrated).

In this inkjet recording apparatus 100, in order to clean the ink ejection surface F1 of the recording head 17, at a start of printing after a long-term shutdown and during an interim between printing operations, purge is executed to extrude the ink 22 having an increased viscosity from the ink ejection ports 18*a* of the head portion 18, and also the cleaning liquid is supplied through the cleaning liquid supply ports (not shown) of the cleaning liquid supply member 20. Then, the wiper 25 (see FIG. 3) of the wipe unit 19 wipes the cleaning liquid supply surface F2 and the ink ejection surface F1. At this time, waste ink and waste cleaning liquid are wiped off by the wiper 25 and collected in a collection tray (not shown) provided in the wipe unit 19, and then sent via a waste ink tube into a waste ink tank (not shown) to be stored therein. This recovery operation for the recording head 17 is executed by controlling, based on a control signal from a control portion 110 (see FIG. 1), operations of the recording head 17, the wipe unit 19, the purge pump 72, and so on.

Next, a description will be given of a structure of and around the sub ink tank 50.

Figure 6:
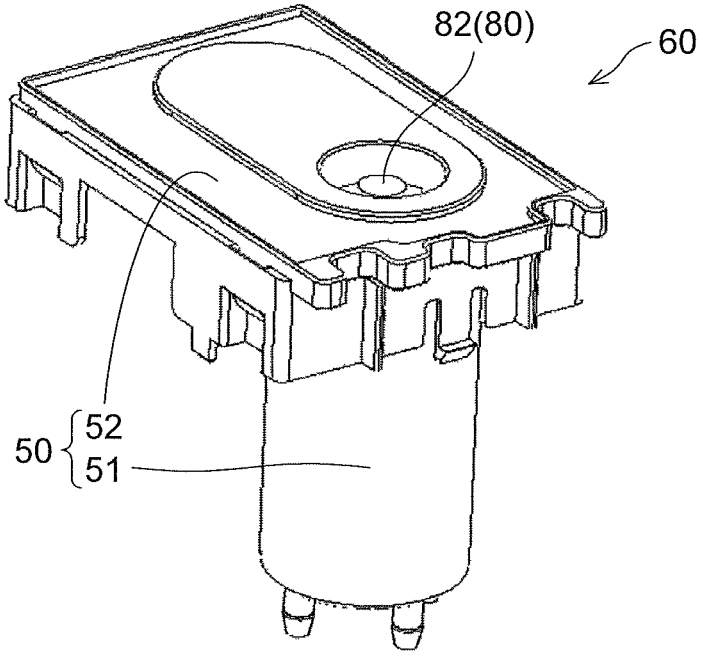
FIG. 6 is diagram illustrating an external appearance of the supply liquid tank unit according to the embodiment of the present disclosure.
Figure 7:
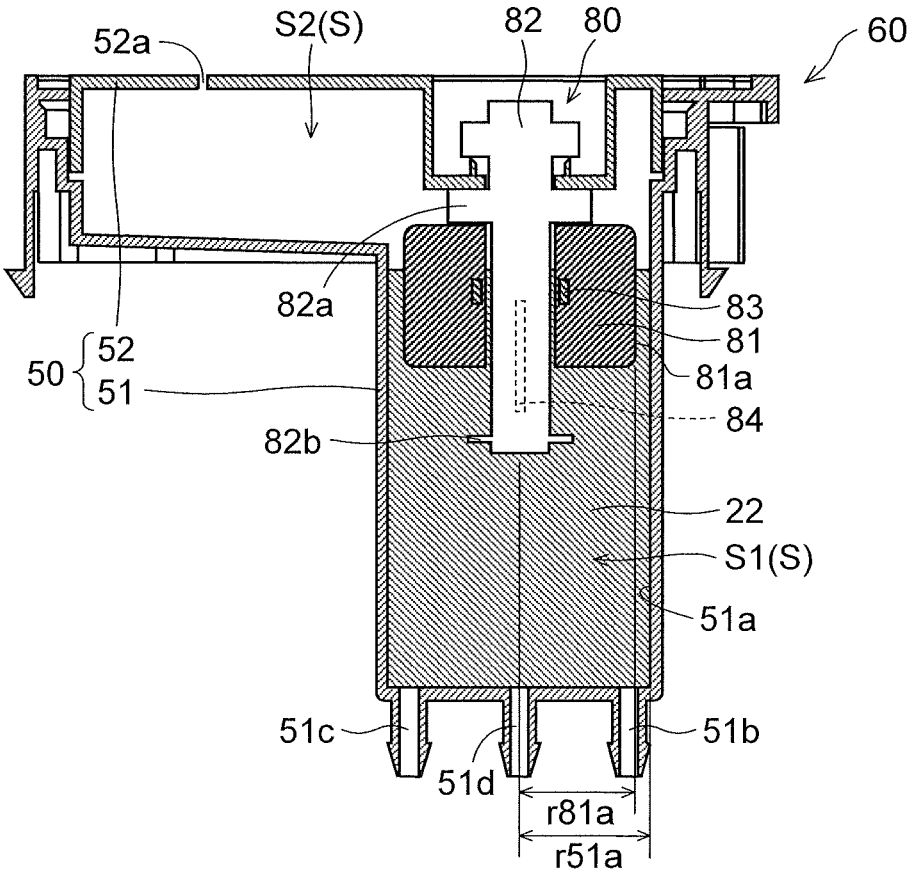
FIG. 7 is a diagram illustrating a structure of the supply liquid tank unit according to the embodiment of the present disclosure, illustrating a state where a float is located at an upper limit position.
Figure 8:
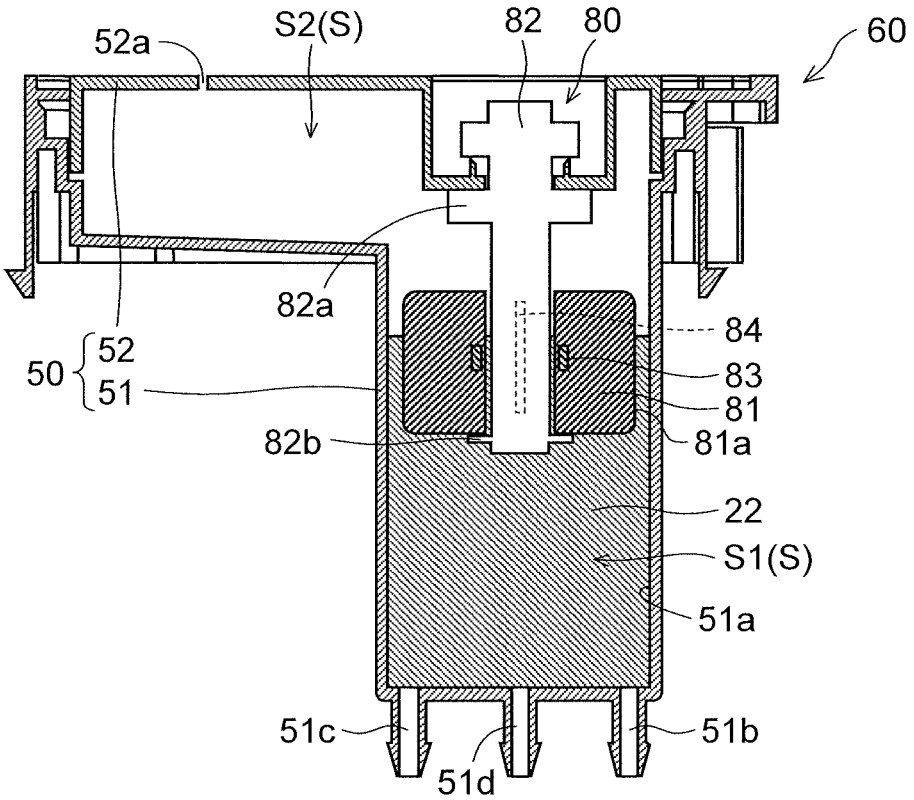
FIG. 8 is a diagram illustrating the structure of the supply liquid tank unit according to the embodiment of the present disclosure, illustrating a state where the float is located at a lower limit position.

As illustrated in FIG. 6 and FIG. 7, the sub ink tank 50 includes a tank main body portion 51 and a lid portion 52 which is attached to an upper portion of the tank main body portion 51. As illustrated in FIG. 7, the sub ink tank 50 is provided with an inner space S having a storage chamber S1 which stores the ink 22 and an upper chamber S2 disposed above the storage chamber S1.

The storage chamber S1 is formed in a cylindrical shape. In other words, the storage chamber S1 is formed to be circular in plan view. The upper chamber S2 is so formed as to project outward in a radial direction with respect to the storage chamber S1. The upper chamber S2 is formed to be elliptic in plan view. In plan view, a sectional area of the upper chamber S2 is formed to be two or more times (here, three times) as large as that of the storage chamber S1.

The detection sensor 80 includes a float 81 which is disposed in the storage chamber S1 and moves vertically in accordance with an amount of ink in the storage chamber S1 and a sensor main body 82 which is rod shaped and detects a liquid surface of the ink 22 when the float 81 moves in a vertical direction. The float 81 is formed in a cylindrical shape, and provided with a magnet 83 disposed therein. The sensor main body 82 is inserted through a center portion of the float 81, and has a top portion thereof secured to the lid portion 52. Inside the sensor main body 82, there is provided a lead switch 84 which operates when the magnet 83 moves in the vertical direction.

An inner side surface 51*a* of the storage chamber S1 is disposed near and along an outer circumferential surface 81*a* of the float 81. Specifically, the inner side surface 51*a* of the storage chamber S1 and the outer circumferential surface 81*a* are spaced from each other by a gap that is equal to or less than 4 mm, and preferably equal to or less than 2 mm. In the present embodiment, the storage chamber S1 is formed such that a radius r51*a* with the inner side surface 51*a* thereof is about 15.0 mm, and the float 81 is so formed that a radius r81*a* with the outer circumferential surface 81*a* thereof is about 13.1 mm. Accordingly, the gap between the inner side surface 51*a* of the storage chamber S1 and the outer circumferential surface 81*a* of the float 81 is about 1.9 mm.

Furthermore, the sensor main body 82 is provided with an upper limit restricting portion 82*a* and a lower limit restricting portion 82*b*, both projecting outward in the radial direction to restrict the vertical movement of the float 81. The float 81 is movable in a range from an upper limit position (the position in FIG. 7) at which an upper end of the float 81 is in contact with the upper limit restricting portion 82*a* and a lower limit position (the position in FIG. 8) at which a lower end of the float 81 is in contact with the lower limit restricting portion 82*b*. Here, when the liquid surface of the ink 22 falls to the position in FIG. 8, the float 81 falls to the lower limit position (the position in FIG. 8). This activates the lead switch 84, and a replenishment signal is transmitted from the sensor main body 82 to the control portion 110, which performs control such that a predetermined amount of ink 22 is replenished from the ink pack 76 to the sub ink tank 50. As a result, the liquid surface of the ink 22 rises to the position in FIG. 7, and the float 81 rises to the upper limit position (the position in FIG. 7).

Furthermore, in a state where the float 81 is located at the lower limit position (the position in FIG. 8), assuming that a volume of the ink 22 in the storage chamber S1 is represented by V ($cm^3$) and an area of an ink surface exposed to air is represented by Q ($mm^2$), the volume V and the area Q satisfy a relationship of $Q/V \leq 10$, and preferably satisfy a relationship of $Q/V \leq 6$. In the present embodiment, the volume V is about 30 $cm^3$, and the area Q is about 170 $mm^2$. Accordingly, the value of Q/V is approximately 5.7.

In an upper surface of the lid portion 52, there is formed an atmosphere release port 52*a* for making an internal pressure in the inner space S equal to the atmospheric pressure. Furthermore, as illustrated in FIG. 5, the sub ink tank 50 is disposed at a height such that the liquid surface of the ink 22 is a little below the recording head 17. With this arrangement, a negative pressure is applied to the ink 22 in the recording head 17, and, at a constant position (at a lower end of the ink ejection port 18*a* of the recording head 17), a meniscus of the ink 22 is formed to be curved toward an inside (an upside) of the recording head 17. Furthermore, when the ink 22 is ejected through the ink ejection ports 18*a*, the ink 22 of an amount equal to the ejected amount thereof is naturally (without operating the purge pump 72) supplied from the sub ink tank 50 to the recording head 17.

As illustrated in FIG. 7, in the storage chamber S1, at a position below the movement region of the float 81, there are provided an inlet 51*b* to which the downstream end of the ink replenishment tube 75 (see FIG. 5) is connected and through which the ink 22 flows into the storage chamber S1, an outlet 51*c* to which the upstream end of the ink supply tube 70 (see FIG. 5) is connected and through which the ink 22 flows out of the storage chamber S1, and a connection port 51*d* to which a downstream end of a later-described air discharge tube 73 (see FIG. 9) is connected. Here, the inlet 51*b*, the outlet 51*c*, and the connection port 51*d* are provided at a bottom surface of the storage chamber S1.

Figure 9:
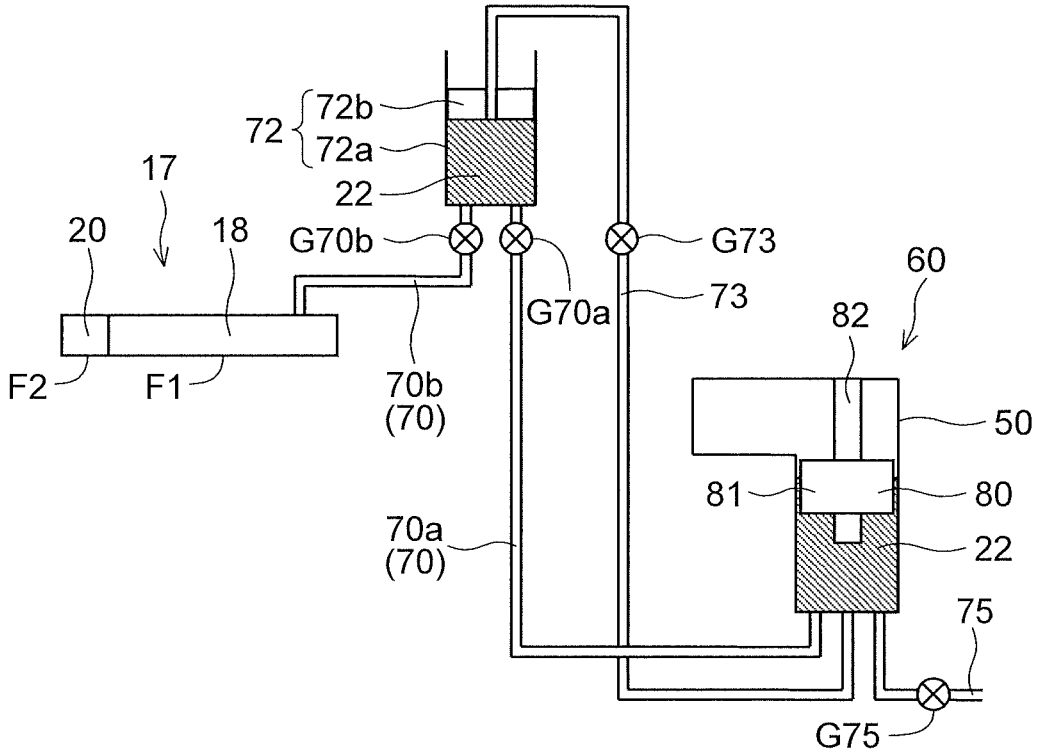
FIG. 9 is a diagram illustrating a configuration of and around the sub ink tank and a purge pump.
Figure 10:
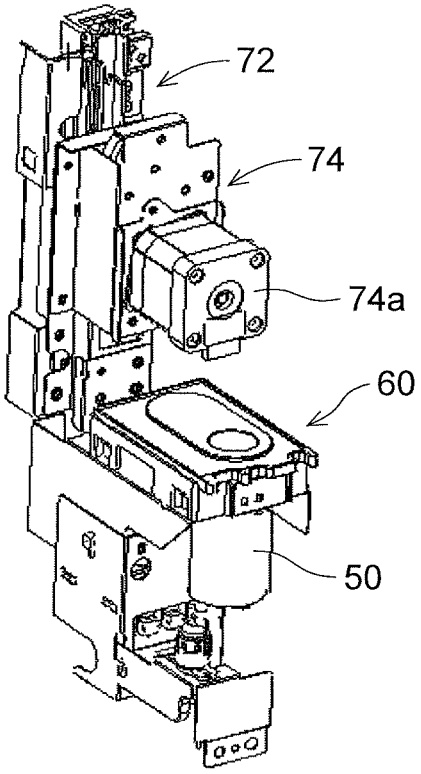
FIG. 10 is a diagram illustrating an external appearance of and around the sub ink tank and the purge pump.

As illustrated in FIG. 9, the purge pump 72 includes a cylinder 72*a* having a shape with a cavity, and a piston portion 72*b* which is disposed in the cavity of the cylinder 72*a* and caused to move along a longitudinal direction of the cylinder 72*a* by a drive mechanism 74 having a drive motor 74*a* (for both, see FIG. 10). On an outer circumference of the piston portion 72*b*, there is provided a packing (not shown) such as an O ring.

The ink supply tube 70 includes an upstream-side tube 70*a* and a downstream-side tube 70*b*, and to a bottom surface of the cylinder 72*a*, a downstream end of the upstream-side tube 70*a* leading to the sub ink tank 50 and an upstream end of the downstream-side tube 70*b* leading to the recording head 17 are connected.

Furthermore, to the piston portion 72*b*, an upstream end of the air discharge tube 73 is connected which allows air from the purge pump 72 to pass therethrough. This air discharge tube 73 is provided for the purpose of discharging air from the purge pump 72 in a case where air has gradually entered the purge pump 72 for some reason (for example, a foreign object caught between an inner side surface of the cylinder 72*a* and the piston portion 72*b*). The air thus having entered the purge pump 72 stays at a border between the piston portion 72*b* and a liquid surface (an upper surface) of the ink 22. Thus, by moving the piston portion 72*b* downward, it is possible to cause the air in the purge pump 72 to move via the air discharge tube 73 to the sub ink tank 50. This air discharge operation is performed regularly (for example, about once a week).

The ink replenishment tube 75, the upstream-side tube 70*a*, the downstream-side tube 70*b*, and the air discharge tube 73 are respectively provided with electromagnetic valves G75, G70*a*, G70*b*, and G73, each for opening and closing an ink flow passage (or an air flow passage). The opening-closing operation of each of the electromagnetic valves G75, G70*a*, G70*b*, and G73 is executed by the control portion 110.

In this inkjet recording apparatus 100, during a printing operation, the electromagnetic valves G75 and G73 are closed while the electromagnetic valves G70*a* and G70*b* are opened. During a purge operation, the electromagnetic valves G75 and G73 are closed while the electromagnetic valves G70*a* and G70*b* are opened or closed as necessary. When the ink 22 in the sub ink tank 50 is consumed in a printing operation or a purge operation to cause the liquid surface of the ink 22 to fall and the float 81 to reach the lower limit position (the position in FIG. 8), the lead switch 84 (see FIG. 8) is activated. Consequently, the electromagnetic valve G75 is opened, and a predetermined amount of ink 22 is replenished from the ink pack 76 to the sub ink tank 50. As a result, the liquid surface of the ink 22 rises to the position in FIG. 7, and also, the float 81 rises to the upper limit position (the position in FIG. 7), and then the electromagnetic valve G75 is closed.

During an air discharge operation, the electromagnetic valves G75, G70*a*, and G70*b* are closed while the electromagnetic valve G73 is opened. When the piston portion 72*b* is caused to move downward, air in the purge pump 72 moves via the air discharge tube 73 to the sub ink tank 50. At this time, part of the ink 22 in the purge pump 72 also moves to the sub ink tank 50. Thus, in a case where the liquid surface of the ink 22 in the sub ink tank 50 is located, for example, at the position in FIG. 7 before an air discharge operation is performed, the ink 22 in the sub ink tank 50 flows out of the storage chamber S1 into the upper chamber S2 when the air discharge operation is performed.

In the present embodiment, as described above, the inner side surface 51*a* of the storage chamber S1 of the sub ink tank 50 is disposed along and near the outer circumferential surface 81*a* of the float 81 of the detection sensor 80. With this configuration, it is possible to reduce the surface area Q of the ink 22 that is exposed to air, and thus to reduce dissolution of air into the ink 22. Thus, in a case where the ink 22 is heated in the recording head 17, it is possible to reduce generation of air bubbles in the ink 22, and thus to reduce occurrence of failed ejection of the ink 22.

Furthermore, as described above, the inlet 51*b* and the outlet 51*c* are provided at positions in the storage chamber S1 that are below the movement region of the float 81. With this configuration, the replenishment tube 75 and the ink supply tube 70, for example, do not need to be so disposed as to pass through the gap between the inner side surface 51*a* of the storage chamber S1 and the outer circumferential surface 81*a* of the float 81, and this makes it easy to dispose the inner side surface 51*a* of the storage chamber S1 along and near the outer circumferential surface 81*a* of the float 81. Thus, it is possible to easily reduce the surface area Q of the ink 22 that is exposed to air.

Furthermore, as described above, the volume V and the surface area Q of the ink 22 satisfy a relationship of $Q/V \leq 10$, and preferably satisfy a relationship of $Q/V \leq 6$. This makes it possible to sufficiently reduce, with respect to the volume V of the ink 22, the surface area Q of the ink 22 that is exposed to air, and thus to sufficiently reduce concentration of air dissolved in the ink 22. Thus, in a case where the ink 22 is heated in the recording head 17, it is possible to sufficiently reduce generation of air bubbles in the ink 22, and thus to sufficiently reduce occurrence of failed ejection of the ink 22.

Furthermore, as described above, the gap between the inner side surface 51*a* of the storage chamber S1 and the outer circumferential surface 81*a* of the float 81 is equal to or less than 4 mm, and is preferably equal to or less than 2 mm. With this configuration, it is possible to sufficiently reduce the surface area Q of the ink 22 that is exposed to air, and thus to sufficiently reduce dissolution of air into the ink 22.

Furthermore, as described above, in plan view, the sectional area of the upper chamber S2 is larger than that of the storage chamber S1. With this configuration, even in a case where the ink 22 of an amount larger than usual is sent to the sub ink tank 50 for some reason (for example, as a result of the ink 22 being sent from the purge pump 72 to the sub ink tank 50 when the above-described air discharge operation of the purge pump 72 is performed), it is possible to easily reduce overflow of the ink 22 from the sub ink tank 50.

It should be understood that the embodiments disclosed herein are merely illustrative in all respects, and should not be interpreted restrictively. The range of the present disclosure is shown not by the above descriptions of the embodiments but by the scope of claims for patent, and it is intended that all modifications within the meaning and range equivalent to the scope of claims for patent are included.

Figure 11:
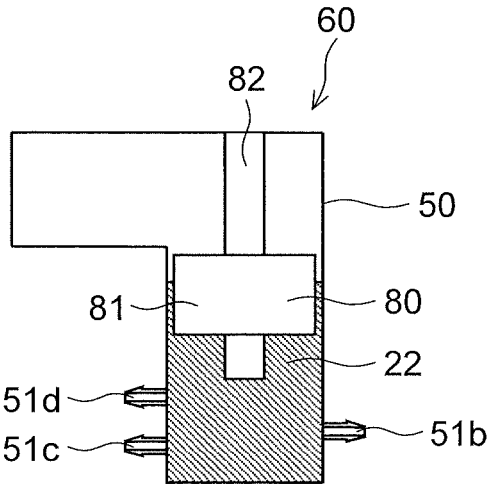
FIG. 11 is a diagram illustrating a structure of a sub tank ink of a supply liquid tank unit according to a first modified example of the present disclosure.

For example, in the embodiment described above, an example has been dealt with in which the inlet 51*b*, the outlet 51*c*, and the connection port 51*d* are provided at the bottom surface of the storage chamber S1, but this is not meant to limit the present disclosure. For example, as in a sub ink tank 50 of a supply liquid tank unit 60 of a first modified example of the present disclosure illustrated in FIG. 11, the inlet 51*b*, the outlet 51*c*, and the connection port 51*d* may be disposed at a side surface of the storage chamber S1. Alternatively, the connection port 51*d* may be provided at a side surface of an upper chamber S2.

Figure 12:
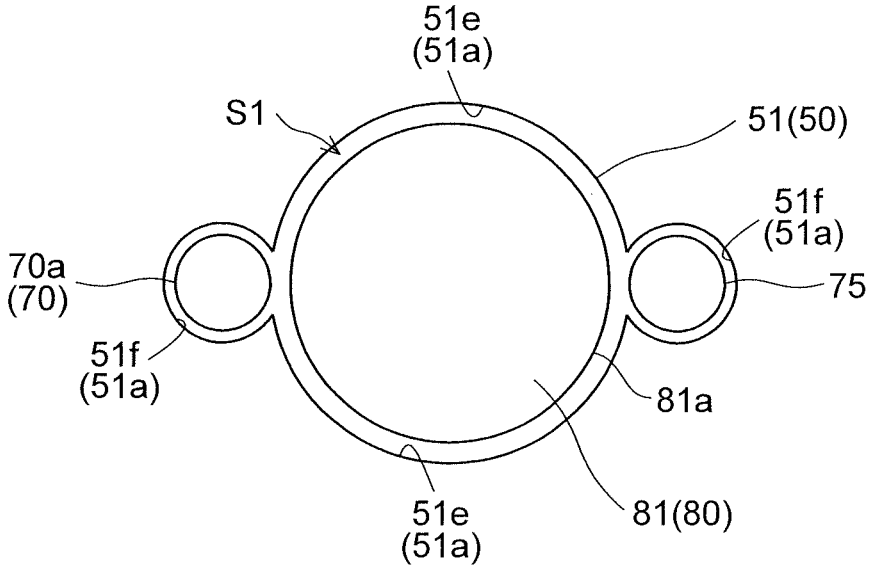
FIG. 12 is a diagram illustrating a structure of a sub tank ink of a supply liquid tank unit according to a second modified example of the present disclosure.

Furthermore, in the embodiment described above, an example has been dealt with in which the ink replenishment tube 75 through which the ink 22 flows into the storage chamber S1 and the ink supply tube 70 through which the ink 22 flows out from the storage chamber S1 are respectively connected to the inlet 51*b* and the outlet 51*c* provided at the bottom surface of the storage chamber S1, but this is not meant to limit the present disclosure. For example, there may be adopted the configuration of a supply liquid tank unit 60 of a second modified example of the present disclosure illustrated in FIG. 12. Specifically, at the inner side surface 51*a* of the storage chamber S1, there may be provided a float opposing region 51*e* which is disposed opposite the outer circumferential surface 81*a* of the float 81 and tube opposing regions 51*f* which are each disposed opposite an outer circumferential surface of either the ink replenishment tube (inlet tube) 75 or the ink supply tube (outlet tube) 70. And, the downstream end of the ink replenishment tube 75 and the upstream end of the ink supply tube 70 may be disposed at positions in the storage chamber S1 that are below the movement region of the float 81, and the ink replenishment tube 75 and the ink supply tube 70 may be configured to extend upward along the outer circumferential surface 81*a* of the float 81 and pass through the upper chamber S2. With this configuration, even in a case of inserting the ink replenishment tube 75 and the ink supply tube 70 from the upper chamber S2 into the storage chamber S1, it is possible to reduce the surface area Q of the ink 22 that is exposed to air.

Furthermore, the embodiment described above has dealt with an example in which the ink pack 76 is disposed below the sub ink tank 50, and the ink 22 is replenished by the replenishment pump 77 from the ink pack 76 to the sub ink tank 50, but this is not meant to limit the present disclosure. The ink pack 76 may be disposed above the sub ink tank 50, and the ink 22 may be replenished from the ink pack 76 to the sub ink tank 50 by making use of liquid head difference.

What is claimed is:

1. A supply liquid tank unit comprising:

a supply liquid tank which stores ink to be supplied to a recording head which ejects the ink onto a recording medium; and a detection sensor which detects a liquid surface of the ink in the supply liquid tank, wherein the supply liquid tank is provided with an inner space having a storage chamber which stores the ink and an atmosphere release port for making an inner pressure of the inner space equal to an atmospheric pressure, the detection sensor has a float which moves vertically in accordance with an amount of the ink in the storage chamber and a sensor main body which detects a liquid surface of the ink when the float moves in a vertical direction, an inner side surface of the storage chamber is disposed along and near an outer circumferential surface of the float, and in a state where the float is located at a lower limit position, assuming that a volume of the ink in the storage chamber is represented by V (cm3) and a surface area of the ink exposed to air is represented by Q (mm2), the volume V and the surface area Q satisfy a relationship of $Q/V \leq 10$.

2. The supply liquid tank unit according to claim 1, wherein the supply liquid tank has an inlet through which the ink flows into the supply liquid tank and an outlet through which the ink flows out of the supply liquid tank, and the inlet and the outlet are provided at positions in the storage chamber that are below a movement region of the float.

3. The supply liquid tank unit according to claim 1, further comprising:

an inlet tube through which the ink that flows into the storage chamber passes; and an outlet tube through which the ink that flows out of the storage chamber passes, wherein the inlet tube and the outlet tube are disposed to extend in the vertical direction along the outer circumferential surface of the float, and the inner side surface of the storage chamber includes a float opposing region which is disposed opposite the outer circumferential surface of the float and tube opposing regions which are each disposed opposite an outer circumferential surface of either the inlet tube or the outlet tube.

4. The supply liquid tank unit according to claim 1, wherein the volume V and the surface area Q satisfy a relationship of $Q/V \leq 6$.

5. The supply liquid tank unit according to claim 1, wherein the inner space has an upper chamber disposed above the storage chamber, and in plan view, a sectional area of the upper chamber is larger than a sectional area of the storage chamber.

6. An inkjet recording apparatus comprising the supply liquid tank unit according to claim 1; and a conveyance portion which conveys a recording sheet.

7. A supply liquid tank unit comprising:

a supply liquid tank which stores ink to be supplied to a recording head which ejects the ink onto a recording medium; and a detection sensor which detects a liquid surface of the ink in the supply liquid tank, wherein the supply liquid tank is provided with an inner space having a storage chamber which stores the ink and an atmosphere release port for making an inner pressure of the inner space equal to an atmospheric pressure, the detection sensor has a float which moves vertically in accordance with an amount of the ink in the storage chamber and a sensor main body which detects a liquid surface of the ink when the float moves in a vertical direction, an inner side surface of the storage chamber is disposed along and near an outer circumferential surface of the float, and a gap between the inner side surface of the storage chamber and the outer circumferential surface of the float is equal to or less than 4 mm.

8. The supply liquid tank unit according to claim 7, wherein the gap between the inner side surface of the storage chamber and the outer circumferential surface of the float is equal to or less than 2 mm.

* * * * *